US007644660B1

(12) United States Patent
Clark et al.

(10) Patent No.: US 7,644,660 B1
(45) Date of Patent: Jan. 12, 2010

(54) SIMULTANEOUS, MULTI-LAYER PAD PRINTING TRANSFER APPARATUS AND METHOD FOR FLAT AND BULGING PADS

(76) Inventors: Lloyd Douglas Clark, 15 Conrad St., San Francisco, CA (US) 94131-2924; Brian A Brown, 325 Lake St., San Francisco, CA (US) 94118

( * ) Notice: Subject to any disclaimer, the term of this patent is extended or adjusted under 35 U.S.C. 154(b) by 353 days.

(21) Appl. No.: 11/558,911

(22) Filed: Nov. 11, 2006

Related U.S. Application Data

(60) Provisional application No. 60/742,506, filed on Dec. 5, 2005.

(51) Int. Cl.

| | |
|---|---|
| ***B41F 1/16*** | (2006.01) |
| ***B41F 3/34*** | (2006.01) |
| ***B41F 7/02*** | (2006.01) |
| ***B41F 9/01*** | (2006.01) |
| ***B41L 9/00*** | (2006.01) |
| ***B41L 17/08*** | (2006.01) |
| ***B41F 17/00*** | (2006.01) |

(52) U.S. Cl. ..... 101/492; 101/35

(58) Field of Classification Search ..... 101/41, 101/35, 492

See application file for complete search history.

(56) References Cited

U.S. PATENT DOCUMENTS

| | | | | |
|---|---|---|---|---|
| 3,587,455 | A * | 6/1971 | Childress | 101/5 |
| 6,276,266 | B1 * | 8/2001 | Dietz et al. | 101/41 |
| 6,840,167 | B2 | 1/2005 | Clark et al. | |
| 2003/0136281 | A1 | 7/2003 | Clark et al. | |
| 2004/0179081 | A1 * | 9/2004 | Nimi et al. | 347/104 |

FOREIGN PATENT DOCUMENTS

| | | | |
|---|---|---|---|
| DE | 3820340 | C1 | 6/1988 |
| DE | 4020223 | C1 | 6/1990 |

OTHER PUBLICATIONS

U.S. Appl. No. 60/792,254, filed Apr. 14, 2006, L. D. Clark et al.

(Continued)

*Primary Examiner*—Judy Nguyen
*Assistant Examiner*—Leo T Hinze

(57) ABSTRACT

A pad printing system comprises, in one aspect, a flexible pad (100) with a front surface (125). One or more applicator heads (120, 130) applies one or more substances, including inks, paints, coatings, decals, water, varnish, solvents, catalysts, adhesives, and the like, to the front surface of the pad. The various substances can be applied in layers in any order. During or after application of the substance, applicator heads (140, 145) optionally apply treatments, such as radiative energy, gas, humidity, and the like, to the substance being applied. All components of the system are under the control of a controller (150) that derives information about the image to be printed from an image source (155). After an image and any overlying or underlying coatings are applied, the surface of the pad is urged into contact with a receiving object 200, whereupon the image and coatings are transferred from the pad to the receiving object. The pad is flat during application of substances to the pad. It is optionally bulged prior to transfer of the substances to the receiving surface.

20 Claims, 3 Drawing Sheets

OTHER PUBLICATIONS

U.S. Appl. No. 11/464,203, filed Aug. 13, 2006, L.D. Clark et al.
U.S. Appl. No. 11/558,911, filed Nov. 11, 2006, L.D. Clark et al.
Author Unknown, "New PadJet™ Digital Pad Printing System", Graphics Pro Magazine, Sep.-Oct. 2004.
"New PadJet(tm) Digital Pad Printing System", Graphics Pro magazine, Sep./Oct. 2004, Veda Communications Co., Fresno, CA, USA, www.graphicspro.org.

* cited by examiner

SIMULTANEOUS, MULTI-LAYER PAD PRINTING TRANSFER APPARATUS AND METHOD FOR FLAT AND BULGING PADS

CROSS-REFERENCE TO RELATED APPLICATIONS AND PATENT

This application claims priority of our provisional patent application, U.S. Ser. No. 60/742,506, filed Dec. 5, 2005. This application is related to and incorporates all of our pending U.S. patent application Ser. No. 11/464,203, filed Aug. 13, 2006, and our U.S. Pat. No. 6,840,167 (2005) by reference.

BACKGROUND

1. Field

Pad printing, inkjet printing, and a combination of these are used to print labels and for various other printing applications.

2. Prior Art

The concept of applying ink to a flexible pad for subsequent transfer is taught in our above patent. The pad comprises a flat sheet of flexible pad material, such as silicone rubber. It is typically square, 10 cm on a side, and 1.5 cm thick, although other sizes and shapes are useful. The pad can be smaller or larger. The size and shape of the pad are determined by the area and shape of the ink image and final receiving surface.

In this system, the pad is initially flat. Its edges are restrained by a holding bracket. An inkjet head or other marking applicator deposits an image on the flat front pad surface. The image is then transferred to a receiving object.

In a first application, the pad remains flat. The image-bearing, flat pad is brought into contact with a convex, curved surface, such as a golf ball. When the pad is forced against the ball, the pad conforms to the surface of the ball with a rolling motion, transferring the image from the pad to the ball.

In a second application, the initially flat, image-bearing pad is caused to bulge. The pad is forcibly deformed by a ram, or equivalent method, applied to the opposite side of the pad. The bulged pad is then brought into contact with the final receiving surface. The receiving surface in this case can be flat, undulating, or both, such as a cellular telephone case. The previously-applied inkjet image transfers from the pad to the receiving surface. A decorated part results. The principal advantage of this system is the ability to transfer multi-color images in a single step.

SUMMARY

One aspect of an improved pad printing system employs a flexible pad, first and second applicator stations, an image source, and a controller. It adds the ability to simultaneously apply one or more layers of a variety of substances including inks, adhesives, paints, waxes, coatings, and the like, to a receiving surface. These substances can be applied in layers beneath, within, or on top of one-another. Each layer can be optionally treated with external influences such as radiant energy including heat, cold, ultra-violet light, radioactive emission, chemicals, and the like.

ADVANTAGES

One or more aspects of the present system may have one or more of the following advantages. In one aspect, a number of substances can be applied to the pad prior to transfer, then transferred to a receiving object all-at-once. In another aspect, one or more substances can be applied to a pad and these substances transferred to a receiving surface, then one or more additional substances can be applied to the pad for subsequent transfer to the same receiving surface. In still another aspect, a first substance can be applied to the pad followed by a second substance which is a catalyst that affects the properties of the first substance.

Other advantages and features of various aspects will become apparent by a review of the specification, claims, and appended figures.

DRAWING FIGURES

Figure 1:
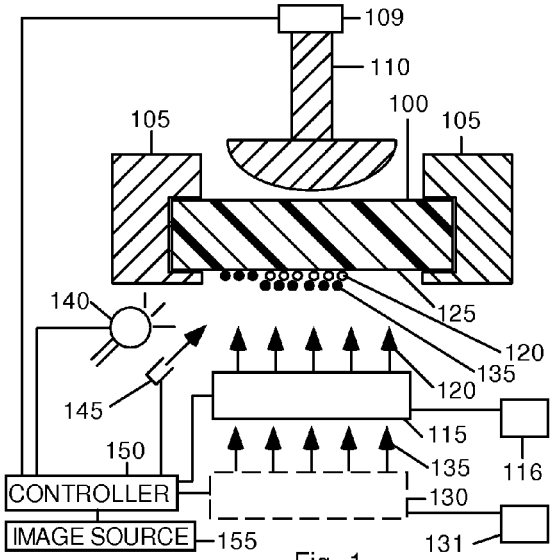
FIG. 1 is a cross-sectional view showing application of one or more image-wise layers of ink or other substance to a flat pad according to one aspect.

| REFERENCE NUMERALS | |
|---|---|
| 100 | Pad |
| 105 | Frame |
| 109 | Actuator |
| 110 | Ram |
| 115 | Applicator station |
| 116 | Source |
| 120 | Substance |
| 125 | Front surface |
| 130 | Applicator station |
| 131 | Source |
| 135 | Substance |
| 140 | Source |
| 145 | Source |
| 150 | Controller |
| 155 | Source |
| 200 | Object |
| 800 | Image |
| 1000 | Layer |
| 1100 | Layer |

DESCRIPTION

First Embodiment—FIG. 1

Figure 2:
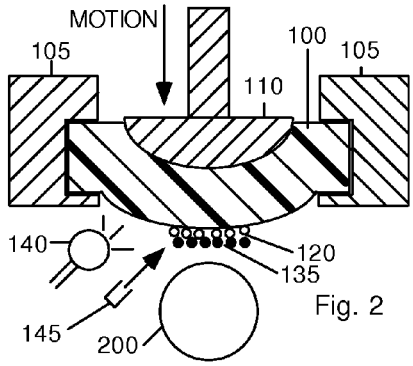
FIG. 2 shows an image-bearing pad of FIG. 1 in a bulged condition.
Figure 3:
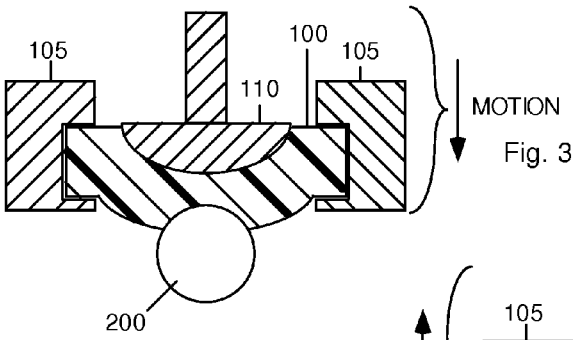
FIG. 3 shows an image transfer step of the application of FIG. 1.
Figure 4:
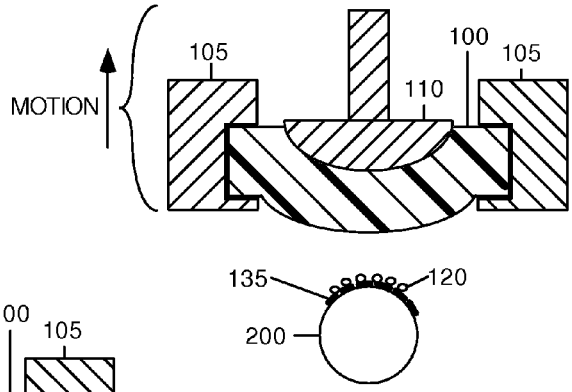
FIG. 4 shows the location of the image after transfer. The pad has been removed from contact with the receiving surface.

In one aspect of a first embodiment, a flexible pad 100 is secured within a rigid frame 105. When energized, an actuator 109 urges a ram 110 against pad 100, deforming it (FIGS. 2-4). A first applicator station 115 comprises an inkjet head, electrostatic print head, spray head, or other such device capable of applying a substance 120, such as ink, paint, adhesive, coating material, catalysts, and the like to the front surface 125 of pad 100. An optional second applicator station 130 is also capable of applying a substance 135, such as ink, paint, adhesive, coating material, catalysts, and the like, to surface 125 and substance 120. Heads 115 and 130 are supplied by sources 116 and 131 that contain supplies of substances 120 and 135, respectively. Heads 115 and 130 can optionally apply high-resolution, multi-color images or simple, non-image layers of substances to surface 125 of pad 100. The heads normally comprise a line of nozzles, although a single nozzle or other arrangement capable of applying substances to surface 125 of pad 100, or as an overlay to droplets 120 or to both, can be used. Heads 115 and 130 are vertically disposed in FIG. 1 for clarity. They normally move under the urging of a mechanism (not shown) that transports them sequentially in a plane parallel to surface 125, and very near to it. Although droplets 120 and 135 are shown projecting upward, the entire assembly in FIG. 1 can be inverted if required. See FIG. 8 for an inverted perspective view. Ink transfer and transport mechanisms are known to those skilled in the art of digital printing.

An optional illumination source 140 is arranged to illuminate droplets 120 and 135 with radiation of a predetermined wavelength from microwaves through ultraviolet light, and other radiation including x-rays, alpha particles, electrons, ions, and gamma rays. Optional heat, cold, gas, and humidity treatment source 145 supplies heat, cold, gas, and humidity to droplets 215 and pad 300. Source 145 can optionally be arranged to apply abrasives. Sources 140 and 145 and their uses are described in our above-mentioned U.S. patent. Emissions from these sources can be applied while droplets 120 and 135 are in transit from heads 115 and 130, or after they are at rest on surface 125 of pad 100.

Heads 115 and 130, actuator 109, and sources 140 and 145 all operate under the control of a controller 150. Controller 150 can be a microcomputer or other logical component that accepts images from a source 155 and provides control signals to the above-mentioned components of the printing system. Controller 150, source 155, and their software are well-known to those skilled in the art of digital printing. Source 155 can comprise a computer memory device, such as a hard disk, a scanner, camera, or the like. Heads 115 and 130 can be the model OmniDot 760 supplied by Xaar PLC of Cambridge, England, or their equivalent.

Operation

First Embodiment FIGS. 1-5

In FIG. 1, pad 100 first receives ink or other substance droplets 120 or 135 or both on front surface 125 from one or more inkjet heads 115 and 130. Prior to transfer of the first image comprising droplets 120, a second layer of droplets 135 is optionally applied to first layer 120 and surface 125. A second layer can be a protective coating, a brightening agent, an ink, a catalyst, or an adhesive, for example.

In all cases, one or more layers of substances are applied to the flattened pad using an inkjet head or other modality, such as a spray nozzle, xerographic transfer, decalcomania, and the like, as discussed in our above patent. In the case of inkjets, heads 115 and 130 typically apply a single line of droplets at a time. In this case, heads 115 and 130 apply lines sequentially to surface 125 by moving parallel to surface 125 in a direction perpendicular to the applied lines.

Heads 115 and 130 can still function acceptably if surface 125 is not absolutely flat. In the case of inkjet heads, a "throw" distance of 2 mm is well-tolerated. I.e. an image will be well-formed if the surface receiving the inkjet image lies within 2 mm of the inkjet head. Other printing methods, such as sprayers, have throw distances that are typically larger.

FIG. 2 shows pad 100 in a bulged condition, ready to transfer droplets 120 and 135 (if present) to the surface of a receiving object 200. Object 200 may be, e.g., a golf ball, a cellular phone housing, or other flat or undulating surface. Actuator 109 (FIG. 1) has been energized, forcing ram 110 into contact with pad 100, thereby deforming it. All layers are next simultaneously transferred to object 200.

FIG. 3 shows pad 100 being pressed against and conforming to the surface of object 200, thereby transferring ink droplets 120 and 135 (if present) to object 200.

FIG. 4 shows the positions of droplets 120 and 135 after transfer to the surface of object 200.

Figure 5:
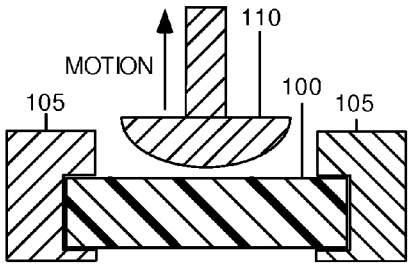
FIG. 5 shows the pad in a flattened condition after transfer, ready to receive ink or other substances for another transfer.

FIG. 5 shows pad 100 in a flat condition, after ram 110 is lifted by actuator 109 (FIG. 1). Pad 100 is now ready to receive another image comprising one or more layers of substances.

Figure 6:
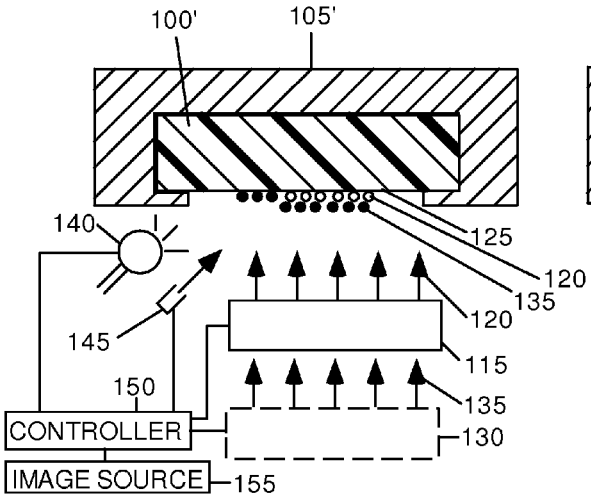
FIG. 6 shows a flat pad with two layers of ink or other substances according to another aspect.
Figure 7:
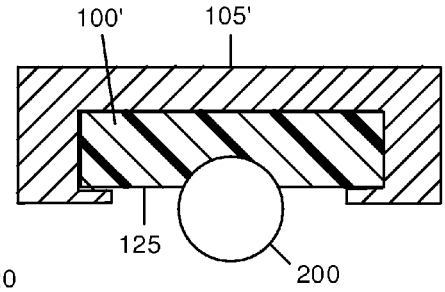
FIG. 7 shows the pad of FIG. 6 transferring the image to a receiving surface.

FIGS. 6 and 7 show the deposition of substances and transfer steps using a flat pad. In this aspect, no provision is made to deform pad 100' because transfer is being made to a domed surface such as a golf ball. Pad 100' differs from pad 100 (FIGS. 1-5) in that it is not necessarily designed to be bulged.

Figure 8:
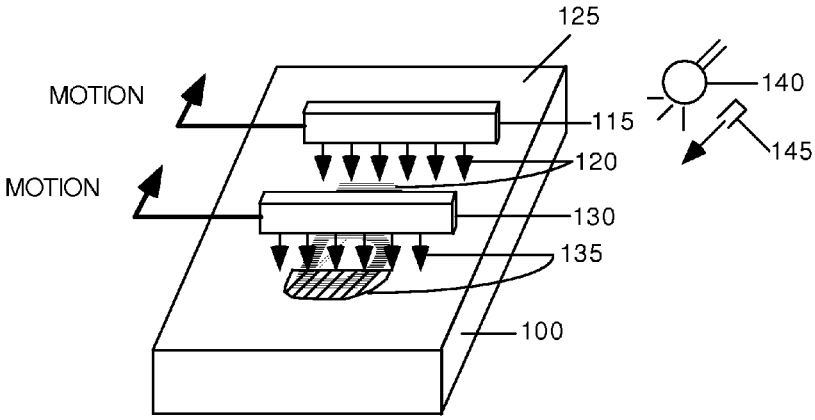
FIG. 8 shows a pad receiving sequentially-applied substances prior to transfer.

FIG. 8 shows a perspective view of applicator heads 115 and 130 during application of ink or other substance 120 and a transparent overlayer coating 135 to surface 125 of pad 100. Heads 115 and 130 are moved by an external mechanism (not shown) that is in communication with controller 150. Sources 140 and 145 are optionally activated, as discussed above.

Applications and Treatments of a Plurality of Layers of Substances

FIGS. 9-13 show the application of various layers including an image only, underlayer, overlayer, under and overlayers, image-outline, and partial under- and over-layers. Sources 140 and 145 serve the same purposes as described in our patent identified above. In the discussion below, sources 140 and 145 are active or not, as required.

Figure 9A:
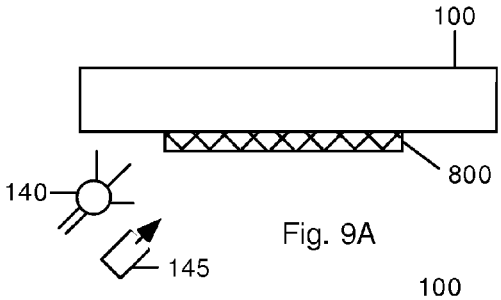
FIGS. 9A through 13B show the applications of layers and treatments to a pad, and treatments to layers after transfer to a receiving surface.
Figure 9B:
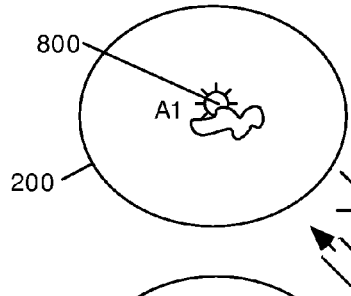

FIG. 9A shows a single layer comprising an image 800 applied to pad 100 by any of the means discussed above and in our previous patent, including inkjet, roller, spray, xerographic, and so forth. FIG. 9B shows image 800 after transfer to receiving object 200. Sources 140 and 145 are shown in FIG. 9B to indicate that either or both of their outputs can optionally be applied to image 800 after it is transferred to object 200.

Figure 10A:
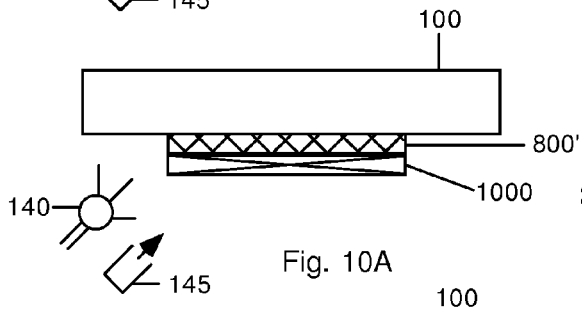
Figure 10B:
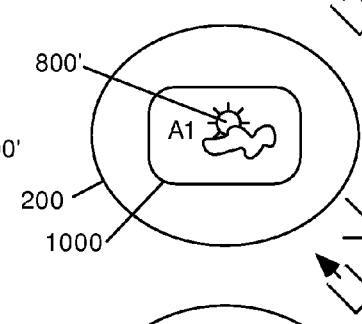

FIG. 10A shows the application of an undercoat and an image to object 200. In a first pass, image 800' is applied to pad 100 using any of the various means described in our above patent. In a second pass, undercoat 1000 is applied over image 800' using any of the materials and means described in our previous patent and above in connection with FIGS. 9A and 9B. Ink image 800' is applied to pad 100 first, followed by undercoat 1000. After transfer to receiving surface 200, their positions will be reversed, i.e. undercoat 1000 will be in contact with surface 200 and lie beneath ink image 800'. One or both layers are optionally treated at any time by sources 140 and 145. Then layers 800' and 1000 are simultaneously transferred to object 200, as shown in FIG. 10B. Again sources 140 and 145 can optionally apply radiant energy, gases, etc. to layers 800' and 1000 on object 200 in order to make image 800' permanent, transparent, invisible, etc.

Figure 11A:
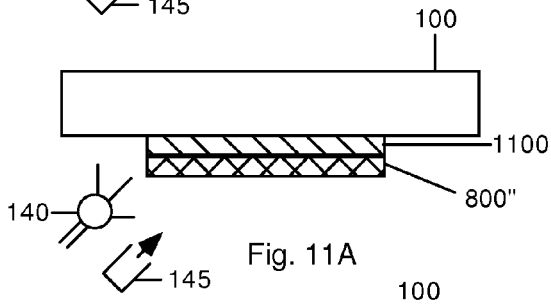
Figure 11B:
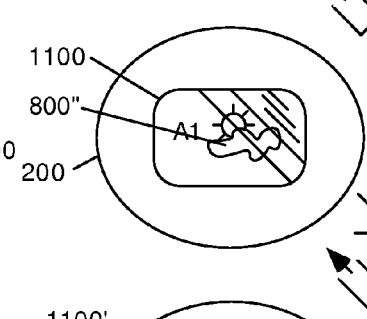

FIG. 11A shows the application of an overcoat and an image to object 200. An overcoat 1100 is first applied to pad 100 by any of the means described above. Then image 800" is applied over overcoat 1100. In FIG. 11B, overcoat 1100 and image 800" have been applied to object 200. Again, both before and after transfer, sources 140 and 145 may be optionally used to change the properties of layers 800" and 1100.

Figure 12A:
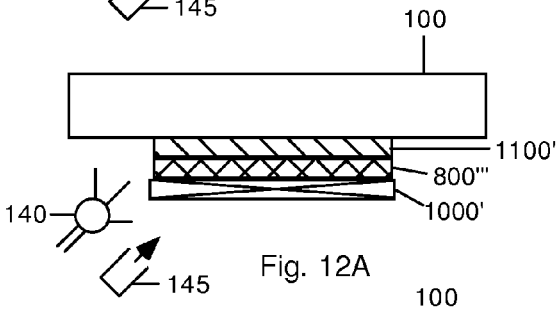
Figure 12B:
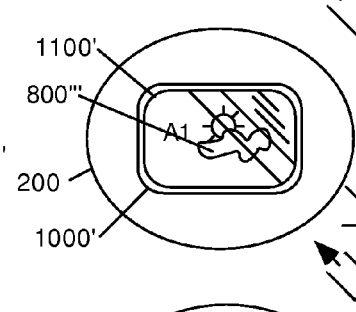

FIG. 12A shows the application of an undercoat, image layer, and overcoat to object 200. An overcoat 1100' is first applied to pad 100, followed by image layer 800'", and finally undercoat 1000'. FIG. 12B shows the three coatings applied to object 200. Undercoat 1000' is in contact with object 200. Image layer 800'" is on top of undercoat 1000', and overcoat 1100' covers both. Again, both before and after transfer, sources 140 and 145 may be optionally used to change the properties of layers 800'", 1000', and 11100'.

Figure 13A:
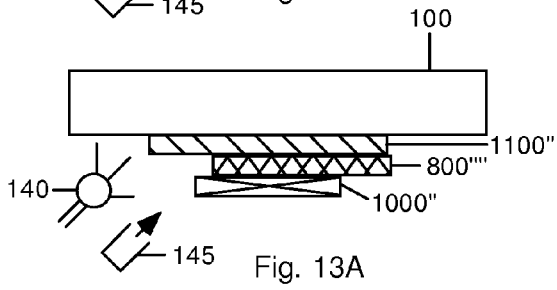
Figure 13B:
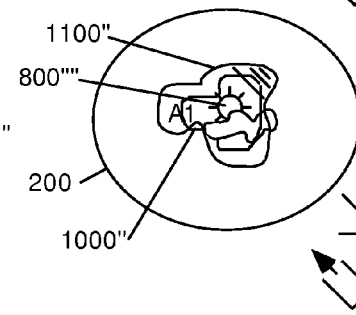

FIGS. 13A and 13B are included to show that the layers need not overlap in the same ways as shown in FIGS. 9-12. In addition, the under- and over-layers need not have any particular shape. In order to save materials (ink, adhesive, overcoat, undercoat, etc.), the various layers can have any shape desired. In FIGS. 13A and 13B the various layers are shown offset with respect to one-another. Undercoat 1000" does not underlay image 800"" at all places. Overcoat 1100" does not cover undercoat 1000" and image 800"" at all places. Again, both before and after transfer, sources 140 and 145 may be optionally used to change the properties of layers 800'", 1000', and 1100'.

The various layers applied may comprise ink, adhesives, varnish, decals, water, solvents, and all others, either singly or in combination, that are used in pad printing. They can be applied to the pad in any order and are then transferred to the receiving object in reverse order. If desired, the layers can be treated singly or in one or more groups by various kinds of radiation, ultraviolet light, radioactive isotope exposure, heat, gases, etc. In this way, multiple layers are first applied to the flattened pad, then the pad is bulged or not bulged, and then the pad is pressed against the receiving surface, transferring the image. The final image can be treated by any of the above modalities of radiant energy, gases, and the like.

Summary, Ramifications, and Scope

The embodiments shown of our improved pad printing apparatus and method incorporate the ability to apply a plurality of materials to a receiving surface in a single operation. The materials can be applied in any order. This permits the combination of image materials, undercoats, and overcoats. Each material can be treated with gases, radiative processes, and the like as it is being applied or after deposition onto the pad, or after transfer to a receiving surface.

While the above description contains many specificities, these should not be considered limiting but merely exemplary. Many variations and ramifications are possible. For example, more than two layers of ink and other substances can be applied to the pad for subsequent transfer. More than two sources can be used to apply substances to the pad or other substances. Repeated applications of ink and other substances to the pad can be transferred to the receiving object for a multi-layer effect. Overlying and underlying substances can be inks, coatings, adhesives, and the like. They can be cured to a dry form, or left liquid or semi-liquid after transfer.

While the present system employs elements which are well known to those skilled in the art of pad printing, it combines these elements in a novel way which produces one or more new results not heretofore discovered. Accordingly the scope of should be determined, not by the embodiments illustrated, but by the appended claims and their legal equivalents.

The invention claimed is:

1. A pad printing system comprising, a flexible pad having a flat front surface, an actuator, a first applicator station supplied with a first substance by a first source and capable of applying said first substance in a first layer to said front surface of said pad, a second applicator station supplied with a second substance by a second source and capable of applying said second substance in a second layer to said front surface of said pad and over said first substance, said first and said second applicators each being an applicator type selected from the group consisting of inkjet, spray, and electrostatic applicators, said first applicator type being selected to be a different type of applicator than said second applicator type within said group so that said first and said second substances can be applied with the appropriate type of applicator for each of said substances, a controller for independently instructing said first and said second applicator stations to apply said layers comprising said first and said second substances to said pad and then optionally instructing said actuator to deform said pad in preparation for simultaneously transferring all layers to a receiving surface, whereby when independently instructed by said controller, said first and said second applicator stations will apply said first and said second layers to said pad so that said pad can be used to transfer said first and second layers from said pad to a receiving surface in a single operation.

2. The system of claim 1 wherein said front surface of said pad is flexible so that it can be urged to bulge.

3. The system of claim 1 wherein said first and said second substances are selected from the group consisting of inks, paints, coatings, decals, water, varnish, solvents, catalysts, and adhesives.

4. The system of claim 1 wherein said first substance is an ink and said second substance is selected from the group consisting of inks, paints, coatings, decals, water, varnish, solvents, catalysts, and adhesives.

5. The system of claim 1 wherein said second substance is an ink and said first substance is selected from the group consisting of inks, paints, coatings, decals, water, varnish, solvents, catalysts, and adhesives.

6. The system of claim 1, further including an illumination source capable of applying illumination to said first and second substances, said source being arranged to supply illumination selected from the group consisting of microwaves, light, and radiation.

7. The system of claim 1, further including a treatment source capable of supplying treatments to said first and second substances, said treatment being selected from the group consisting of heat, cold, gas, abrasives, and humidity.

8. A method of pad printing, comprising:

providing a flexible pad with a front surface, providing a controller, providing a receiving surface, providing a first applicator station responsive to said controller and supplied with a first substance by a first source and capable of applying said first substance in a first layer to said front surface of said pad, providing a second applicator station responsive to said controller and supplied with a second substance by a second source and capable of applying said second substance in a second layer to said front surface of said pad and said first substance, said first and said second applicators each being an applicator type selected from the group consisting of inkjet, spray, and electrostatic applicators, said first applicator type being selected to be a different type of applicator within said group than said second applicator type so that said first and second substances can be applied with the appropriate applicator for each of said substances, applying said layers to said pad under instructions from said controller, pressing said pad against said receiving surface thereby simultaneously transferring said first and said second layers to said receiving surface, whereby when said substances in said layers are applied to said pad and said pad is pressed against said receiving surface, said layers containing said substances will be transferred to said receiving surface all at once.

9. The method of claim 8 further including an actuator responsive to said controller wherein said front surface of said pad can be urged to bulge when instructed by said controller.

10. The method of claim 8 wherein said first and said second substances are selected from the group consisting of inks, paints, coatings, decals, water, varnish, solvents, catalysts, and adhesives.

11. The method of claim 8 wherein said first substance is an ink and said second substance is selected from the group consisting of inks, paints, coatings, decals, water, varnish, solvents, catalysts, and adhesives.

12. The method of claim 8 wherein said second substance is an ink and said first substance is selected from the group consisting of inks, paints, coatings, decals, water, varnish, solvents, catalysts, and adhesives.

13. The method of claim 8, further including an illumination source capable of applying illumination to said first and second substances, said source being arranged to supply illumination selected from the group consisting of microwaves, light, and radiation.

14. The method of claim 8, further including a treatment source capable of supplying treatments to said first and second substances, said treatment being selected from the group consisting of heat, cold, gas, abrasives, and humidity.

15. A pad printing apparatus comprising:

a flexible pad having a flat front surface, an image source, a controller capable of receiving image information from said image source, a first source containing a first substance, a second source containing a second substance, first applicator means responsive to said controller for applying a first layer comprising said first substance to said pad, second applicator means responsive to said controller for applying a second layer comprising said second substance to said first layer and said pad, said first and said second applicators each being an applicator type selected from the group consisting of inkjet, spray, and electrostatic applicators, said first applicator type being selected to be a different type of applicator than said second applicator type within said group so that said first and second substances can be applied with the appropriate applicator for each of said substances, whereby when instructed by said controller, said first applicator means will apply said first layer to said pad and said second applicator means will apply said second layer to said pad, said first layer, or both in preparation for transfer to a receiving surface using a single application of said pad.

16. The apparatus of claim 15 wherein said pad is flexible and can be urged to bulge.

17. The apparatus of claim 15 wherein said first and said second substances are selected from the group consisting of inks, paints, coatings, decals, water, varnish, solvents, catalysts, and adhesives.

18. The apparatus of claim 15, further including an illumination source capable of applying illumination to said first and second substances, said illumination being selected from the group consisting of microwaves, light, and radiation.

19. The apparatus of claim 15, further including a treatment source capable of supplying treatments to said first and second substances, said treatment being selected from the group consisting of heat, cold, gas, abrasives, and humidity.

20. The apparatus of claim 15, whereby when instructed by said controller, said first applicator is capable of applying said first substance over said second substance.

* * * * *